United States Patent [19]

Nelson et al.

[11] 4,038,943

[45] Aug. 2, 1977

[54] SIGNAL AMPLIFICATION BY CHARGING AND ILLUMINATING A PARTIALLY DEVELOPED LATENT ELECTROSTATIC IMAGE

[75] Inventors: Alan C. Nelson, Los Angeles; Lothar S. Jeromin, Sierra Madre, both of Calif.

[73] Assignee: Xerox Corporation, Stamford, Conn.

[21] Appl. No.: 588,573

[22] Filed: June 20, 1975

Related U.S. Application Data

[62] Division of Ser. No. 476,348, June 5, 1974, Pat. No. 3,981,727.

[51] Int. Cl.[2] ..... G03G 15/08

[52] U.S. Cl. ..... 118/647; 96/1.3; 118/654; 250/315 A

[58] Field of Search ..... 250/320, 322, 315 A, 250/315 R; 355/3 R, 3 DD; 118/629, 637; 96/1 R, 1 SD, 1.3

[56] References Cited

U.S. PATENT DOCUMENTS

| | | | |
|---|---|---|---|
| 2,711,481 | 6/1955 | Phillips | 250/315 A |
| 2,756,676 | 7/1956 | Steinhilper | 96/1 R |
| 2,879,397 | 3/1959 | Lehmann | 250/315 A |
| 2,914,403 | 11/1959 | Sugarman, Jr. | 96/1 R |
| 3,526,767 | 9/1970 | Roth et al. | 355/3 R |
| 3,615,395 | 10/1971 | Yamaji et al. | 355/3 R |
| 3,640,246 | 2/1972 | Jeromin et al. | 118/629 |
| 3,646,910 | 3/1972 | Cade et al. | 118/629 |
| 3,650,620 | 3/1972 | Hoyt | 355/3 R |
| 3,730,709 | 5/1973 | Kinoshita et al. | 355/3 R |
| 3,813,546 | 5/1974 | Proudian | 250/315 A |
| 3,850,142 | 11/1974 | Juirblis et al. | 118/637 |
| 3,914,609 | 10/1975 | Jeromin | 250/315 A |

*Primary Examiner*—Mervin Stein

*Attorney, Agent, or Firm*—James J. Ralabate; Franklyn C. Weiss; Anthony W. Karambelas

[57] ABSTRACT

Method and apparatus for reducing X-ray dosage required for xeroradiographic examinations without reducing the relative information capacity of the images produced during the examination. In particular, a charged xerographic plate is positioned adjacent the object to be examined and penetrating X-ray radiation is projected through the object onto the plate surface, forming a latent electrostatic image on the surface of the plate. The penetrating radiation utilized is of a substantially lower dosage than normally utilized. The image is then partially developed with developing powder and the partially developed image is then charged and exposed to substantially uniform radiation. The exposed charged image is finally developed by applying additional developing powder thereto resulting in an enhanced image or signal.

6 Claims, 10 Drawing Figures

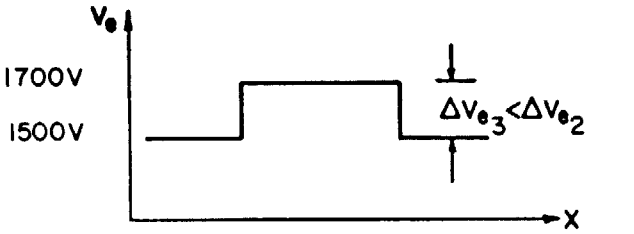
FIG. 1c
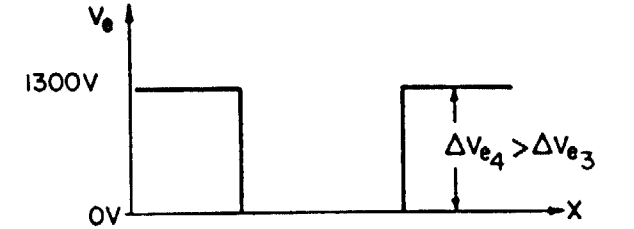
FIG. 1d
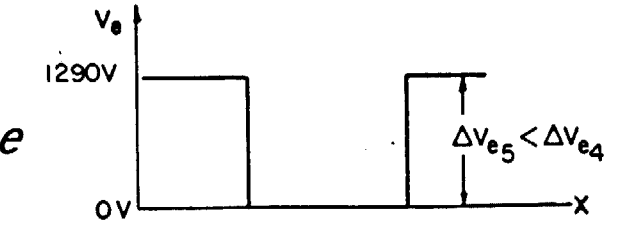
FIG. 1e
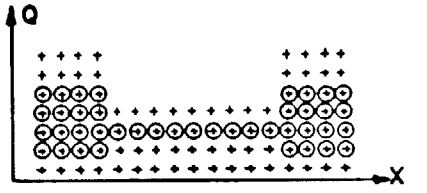
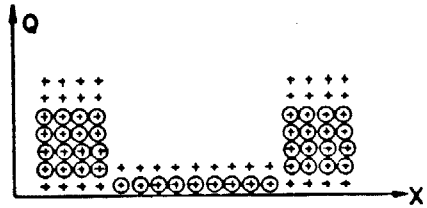
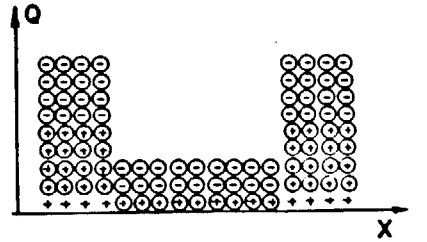

SIGNAL AMPLIFICATION BY CHARGING AND ILLUMINATING A PARTIALLY DEVELOPED LATENT ELECTROSTATIC IMAGE

This is a division of application Ser. No. 476,348, filed June 5, 1974, now U.S. Pat. No. 3,981,727 issued Sept. 21, 1976.

BACKGROUND OF THE INVENTION

Xeroradiography, as disclosed in U.S. Pat. No. 2,666,144, is a process wherein an object is internally examined by subjecting the object to penetrating radiation. A uniform electrostatic charge is deposited on the surface of a xerographic plate, and a latent electrostatic image is created by projecting the penetrating radiation such as X-rays or gamma rays through the object and onto the plate surface. The latent electrostatic image may be made visible by contacting the latent electrostatic image on the plate surface with fine powdered particles selectrically charged opposite to the latent electrostatic pattern on the plate. The visible image may be viewed, photographed or transferred to another surface where it may be permanently affixed or otherwise utilized. The entire processing is dry, and no dark room is necessary.

Xeroradiography in recent years has been utilized to detect breast cancer in women. In the examination of breasts wherein soft tissue comprises most of the breast area, xeroradiography or xeromammography, as it is generally called, provides greater resolving power than the conventional roentgenographic film, and greater image detail is achieved. A wide range of contrast is seen on the xerographic plate as compared to the conventional roentgenographic films so that all structures of the breast from the skin to the chest wall and ribs may be readily visualized. Besides providing better contrast, xeromammography detects small structures like tumor calcification and magnifies them more than conventional film, is quicker, less expensive, gives greater detail and requires less radiation than prior non-photoconductive X-ray techniques.

A factor which has influenced some radiologists to limit xeroradiography applications to the examination of breasts and the extremities (i.e., hands and feet) is the radiation dosage required in examining chests, skulls, hips, etc. as compared to conventional screened X-ray film.

Since a substantial portion of the genrated X-ray radiation will remain in the body tissues of the target area, radiologists have been reluctant to use X-ray systems requiring radiation dosage levels which, although below the recognized minimum safety level, is still higher than that utilized in conventional screened X-ray film.

It would therefore be desirable to provide a technique compatible, for example, with the automated xeroradiographic system described in U.S. Pat. No. 3,650,620, which will reduce the X-ray dosage required to examine particular areas of the human anatomy, such as the chest, while at the same time not reducing the relative information capacity of the developed images.

A system which provides a technique compatible with an automated xerographic system and which requires a reduced X-ray dosage to examine particular areas of the human anatomy is described in copending application Ser. No. 448,128, filed Mar. 4, 1974, now U.S. Pat. No. 3,914,609, issued Oct. 21, 1975 and assigned to the assignee of this application. The technique described therein is operative in either a positive or negative development mode. Although the negative development mode provides satisfactory images, an improved technique for providing high quality images in the negative mode would be desirable.

SUMMARY OF THE PRESENT INVENTION

The present invention provides method and apparatus for reducing the X-ray dosage required for xeroradiographic examinations without reducing the relative information capacity of the images produced during the examination. In particular, a charged xerographic plate is positioned adjacent the object to be examined and penetrating radiation, such as X-rays, are projected through the object onto the plate surface, forming a latent electrostatic image on the surface of the plate. The penetrating radiation utilized is of a lower dosage than normally utilized. The image is then partially developed with developing powder and the partially developed image is then charged and exposed to substantially uniform radiation. The exposed charged image is finally developed by applying additional developer powder thereto resulting in an enhanced image or signal.

It is an object of the present invention to provide method and apparatus for reducing the X-ray dosage required for object examinations in a xeroradiographic system.

It is a further object of the present invention to provide method and apparatus for reducing the X-ray dosage required for object examinations in xeroradiographic systems wherein the latent electrostatic image, after exposure to a reduced dosage of X-rays, is partially developed, charged, exposed to uniform radiation and then finally developed to produce an enchanced image or signal having the equivalent relative information capacity of an image produced by utilizing a high dosage of X-rays.

BRIEF DESCRIPTION OF THE DRAWINGS

For a better understanding of the invention, as well as other objects and further features thereof, reference is made to the following description which is to be read in conjunction with the accompanying drawings wherein:

FIG. 1*a–e* is a representation of the voltage differences and charge patterns formed on the surface of a photoreceptor in accordance with the teachings of the present invention;

DESCRIPTION OF THE PREFERRED EMBODIMENT

Figure 1A:
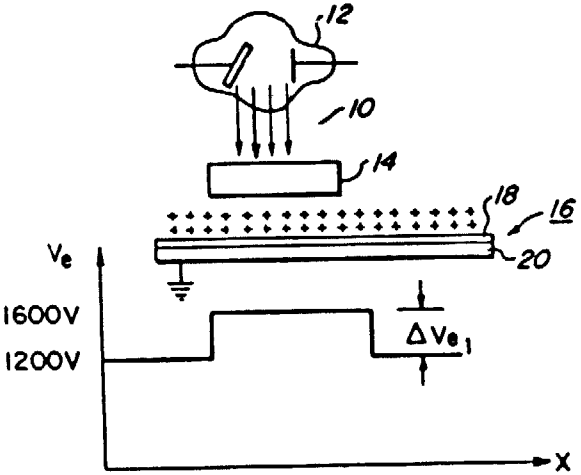
Figure 1B:
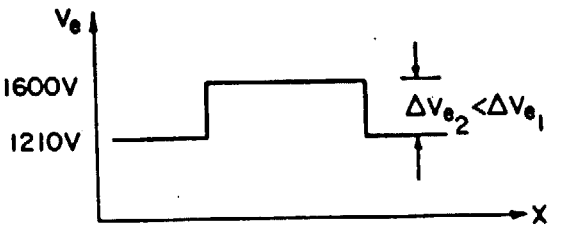

Referring now to FIG. 1, representations (a) through (e) illustrate, in schematical form, one embodiment of the present invention and, in particular, a technique for enhancing the signal level of a negatively developed xeroradiographic image. The left-hand portion of the representations illustrate the voltage levels, Ve, of the electrostatic charge pattern formed on the surface of a xeroradiographic plate as a function of a distance X along the plate whereas the corresponding right-hand portion of the representations illustrate the charge Q (and developer powder deposition) on the plate surface as a function of distance X along the plate surface.

A uniform X-ray beam 10 is generated by a conventional X-ray source 12 and transmitted through an object 14. The X-ray beam is attenuated by the object 14, the subject of the examination procedure, and the transmitted X-rays from the object are modulated in accordance with the density of the object 14 generating a charge pattern of varying surface potentials on the surface of initially positively charged photoreceptor, or xeroradiographic plate 16, comprising photoconductive insulating layer 18, such as vitreous selenium, and conductive substrate 20.

Figure 2:
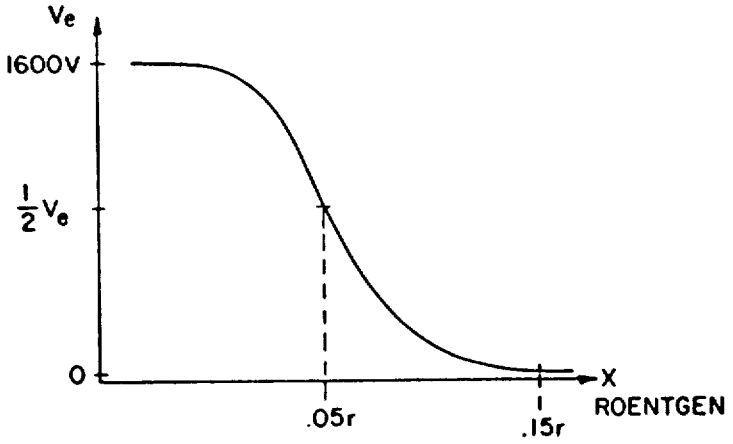
FIG. 2 is an exposure curve illustrating the charge retention capabilities of a photoreceptor after exposure to X-rays.

The difference in surface potential between two areas is referred to as a signal, and for certain small, low density objects, the exposure is optimal when the differences in surface potential (signal) are very large. This is the case, in general, when the average image surface potential falls into the center of the steepest slope of the exposure curve. Any lower or higher exposure for this particular object reduces the signal strength, i.e., reduces the relative information capacity of the image. FIG. 2 illustrates a typical exposure curve wherein the surface potential Ve remaining on the surface of the photoreceptor after exposure is plotted with respect to the roentgen dose *r* of the exposure beam. As can be observed from the graph, the steepest part of the curve is at approximately ½ Ve and 0.05 *r* and corresponds to the optimal surface potential for optimal signal strength.

FIG. 1 describes the invention wherein negative images are formed on the surface of the photoreceptor. In other words, the image, when developed, will be a negative of the object being examined.

The first step of the technique shown at (2) is to expose a charged xeroradiographic plate to the X-rays transmitted by object 14, the surface of the xeroradiographic plate being initially charged, for example, to 1600 volts. Assuming that the object 14 has a uniform absorption characteristic, the resulting representation is a voltage step, corresponding to the X dimension of the object 14, of a magnitude $\Delta Ve_1$; those areas of the photoreceptor surface under the object are not discharged whereas the remaining areas of the plate, corresponding to the width of the X-ray beam, are substantially discharged. In the representation illustrated, the remaining plate areas are discharged to approximately three-fourths of the initial surface potential, i.e., 1200 volts. It should be noted that various techniques can be utilized to charge the surface of the xeroradiographic plate 16 including the well known use of corona generators.

To describe the relative savings in X-ray dosage required, if it is assumed, for example, that the object 14 to be examined is a human chest, an incident dosage of 1 Roentgen (1 r), corresponding to an X-ray source operation at 120 Kvp and 100 mAs would be required by present xeroradiographic techniques. However, in the technique of the present invention, a reduction in the roentgen dose of approximately two to four times can be realized. In the present example, the incident roentgen dosage is reduced by a factor of two, corresponding to 120 Kvp and 50 mAs. The latent electrostatic charge is then partially developed by applying developer powder to the surface of the photoreceptor. As shown at (b), the latent electrostatic charge pattern is then subjected to an initial, or partial, development wherein a negative bias greater than the maximum positive surface potential ($\Delta Ve_1$) is applied to the photoreceptor substrate. Hence, positively charged developer powder particles are deposited denser in the areas of lower surface charge than in the areas of higher surface charge (negative or background development), resulting in the charge and developer powder distribution as shown at the right-hand portion of (b). The positive toner particles form an opaque mask on the surface of the photoreceptor after development. The corresponding potential difference, $\Delta Ve_2$, is less than $\Delta Ve_1$ due to the greater charge deposition in the areas of lower surface charge. A more detailed discussion of the effect of substrate bias on positive-negative development, edge deletion and image contrast control is set forth in copending application Ser. No. 323,666, filed Jan. 15, 1973, now Pat. No. 3,924,568 issued Dec. 9, 1975 and assigned to the assignee of the present invention. In the next step of the invention, a positive charge is applied to the surface of the plate 16 by a corona generator whereby the discharged areas of the plate are selectively recharged, the plate charge gradient effectively being compressed as shown in FIG. 1(c). The deposition of the positive charge on the background areas is controlled by maintaining a selected negative bias on plate substrate 20.

More positive charge deposits on the lower voltage (or background areas) since the voltage gradient between the corona generator and the plate surface thereat is greater than in the image areas. The relative changes in the voltage levels are shown in FIG. 1(c).

In the next step of the present invention (shown in FIG. 1(d)) the surface of the photoreceptor, having the charged, partially developed image thereon exposed uniformly to a light source such as that generated by a standard fluorescent lamp which generates light in the visible spectrum. Since the wavelength of the generated illumination should be compatible with the sensitivity of the photoreceptor, appropriate light filtering is preferably utilized. For example, for the photoreceptor described in the aforementioned U.S. Pat. No. 3,650,620, comprising a conductive backing member having coated on a portion of one surface thereof a photoconductive insulating coating such as vitreous selenium, a blue filter is preferably interposed between the light source and the surface of the photoconductive coating. The light produced by the lamp discharges the lighter developed areas more than the darker area due to the ability of the powder particles to absorb light. The powder particles therefore should have the capability of absorbing light emitted by the aforementioned lamp. The charge pattern formed on the photoreceptor surface is substantially discharged in the image areas since the thickness of the layer of powder particles is less than the thickness of the layer of powder particles in the background areas resulting in a pattern wherein only charged background areas are present, i.e., the latent electrostatic image is inverted after light exposure. The voltage difference, or signal $\Delta Ve_4$, is greater than $\Delta Ve_3$ and greater than the original signal $\Delta Ve_1$.

In the final step shown at (e), the remaining background charge pattern is developed with negatively charged developer powder, the bias on the photoreceptor substrate being at ground or slightly positive, which produces a negatively developed image (or, alternately, development of an inverted image in the positive mode)

having substantially the same relative information capacity of an image produced by utilizing the full X-ray dosage which normally would have been utilized to develop an image of object 14.

The voltage difference at the photoreceptor surface, $\Delta Ve_5$, is approximately 1290 volts which corresponds favorably to the voltage difference (signal) of 1600 volts obtained at full exposure.

It should be noted that the voltage levels shown in FIGS. 1(a)–1(e) are merely illustrative of the technique of the present invention and other levels are possible, the representations providing an indication of the relative voltage levels obtainable with a reduced X-ray dosage.

In order to reduce the granularity of the negative image produced, the surface of the photoconductive layer 18 may be slightly AC charged after initial development.

It should be further noted that the developer powder used for final development may be of a different color than the developer powder utilized during partial development to produce better image contrast. For example, a blue developer powder can be used for the partial development whereas a black developer powder may be utilized for final development.

Figure 3:
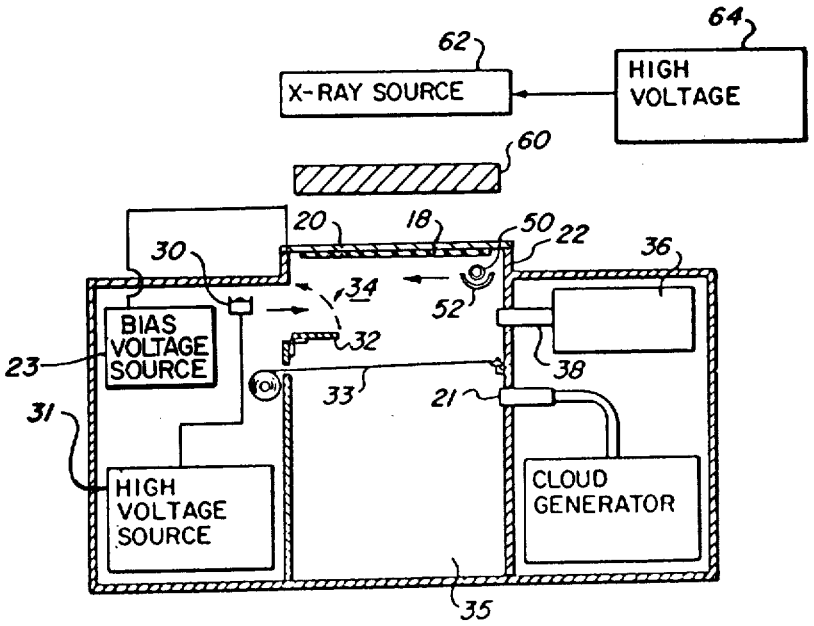
FIG. 3 shows a diagrammatic cross-section of apparatus which may be utilized to implement the teachings of the present invention.

Referring now to FIG. 3, apparatus which may be utilized to implement the technique of the present invention is illustrated. In particular, a xerographic plate composed of layer 18 overlying conductive member 20 is placed on supports 22, a source of biasing potential 23 being applied to conductive member 20. The plate is sensitized or charged by passing across the surface of layer 18 corona discharge electrode 30 preferably comprising one or several fine conductive strands supplied with a corona-generating voltage from high voltage source 31. Door 32 in a side of chamber 34 is adapted to open to allow corona discharge electrode 30 to enter chamber 34. Electrode 30 is driven by conventional drive means while supported and positioned by guide means and when operated will pass in front of and across the surface of plate layer 18 to place thereon a uniform electrostatic charge while conductive member 20 is at a positive potential. A sliding member 33 is positioned within one side of chamber 34 and formed to completely enclose powder cloud storing area 35 and separate it from chamber 34 when conventional means are utilized for pulling the sliding member across the lower portion of chamber 34. When the system is operative, sliding member 33 is released to allow it to rewind upon itself due to a spring controlled recoil action creating one open area composed of powder cloud storing area 35 and chamber 34. A vacuum cleaner 36 is positioned to allow vacuum cleaner nozzle 38 to extend through a side in chamber 34. Cloud spray nozzle 21 extends into cloud storing area 35 from a cloud generator with powder particles mixed in pressurized air. Nozzle 21 has an internal opening through which the particles supplied in pressurized air are supplied to the cloud storing area 35. In the negative mode of development and assuming the plate surface is sensitized with positive charge, positively charged powder particles are attracted to the background areas of the latent electrostatic image on the surface of layer 18. A light source 50, having an elliptical reflector 52 adjacent thereto, is provided adjacent photoconductive layer 18. Light source 50 is driven by conventional drive means, such as a motor driven lead screw, in a scanning mode in front of and across the surface of photoconductive layer 18. An initial negative bias is applied to conductive substrate 20 having a value greater than the initial positive surface potential.

In operation, an object to be examined may be placed on conductive member 20, conductive member 20 acting as a support for the object 60 to be examined. Door 32 opens to the position shown and corona electrode 30 is caused to traverse across the surface of layer 18 supplying charge thereto. At the end of the charging pass door 32 closes. An exposure is then made by causing penetrating radiation generated by X-ray source 62 to be directed to and through object 60, source 62 being energized by high voltage supply 64. During initial exposure, sliding member 33 remains in a closed position while a cloud of charged developer particles are supplied to storage area 35. Following exposure, sliding member 33 is released making storage area 35 and chamber 34 one enclosure. The cloud of developer particles in air which is already generated and which is continuously being generated during development is supplied to the plate following exposure by allowing the powder cloud to flow upward into the area of influence of the electrostatic latent image on the surface of layer 18. After the proper development time has elapsed, sliding member 33 returns to its closed position and vacuum cleaner 36 may be operated to purge the remaining cloud of particles in air from chamber 34. An air intake valve may also be opened to prevent the creation of a negative pressure within chamber 34. After initial development, door 32 again opens to the position shown and corona electrode 30 is caused to traverse, or scan, across the surface of layer 18, applying positive charge thereto. After the surface of layer 18 is charged, door 32 may be closed. The light source 50 is then caused to traverse the photoconductive layer 18 in a scanning mode of operation and to expose layer 18 to illumination of a proper wavelength as explained hereinabove. After the scanning operation, light source 50 is caused to return to its initial position by conventional means. After the light exposure, sliding member 33 is again released and the cloud of developer particles is supplied again to the plate surface, thereby finally developing the image (prior to the final development step, the bias of plate substrate 20 is changed to a positive bias). Sliding member 33 returns to its closed position and the purge cycle is repeated. At this point the plate is ready for viewing and/or further processing to obtain a permanent record of the image and the object is removed to give access to the plate. This cycle of operation which has just been described may then be repeated.

The plate used in connection with this invention may be a conventional plate used in the art of xeroradiography as set forth hereinabove and includes plates generally used in xerographic apparatus. Backing member 20 may be any conductive material, a preferred plate, however, having a backing member composed of aluminum or aluminum having a radiation absorbant coating thereon such as a coating of lead. Other metals or conductors operate very well in this invention when used as backing members in properly formed xeroradiographic plates. Layer 16 should be composed of a material which becomes conductive when exposed to penetrating radiation and which in the absence of penetrating radiation is a good insulator. Typical materials which may be employed in accordance with the present invention include amorphous or vitreous selenium.

Although the preferred type of development is powder cloud development, other known means of development may be utilized, such as, for example, dusting the surface carrying the electrostatic latent image as is disclosed in U.S. Pat. No. 2,297,691, cascading a two-component developer across the surface of the plate member as is disclosed in U.S. Pat. No. 2,618,552, liquid development and other techniques of development known to those in the art.

Figure 4:
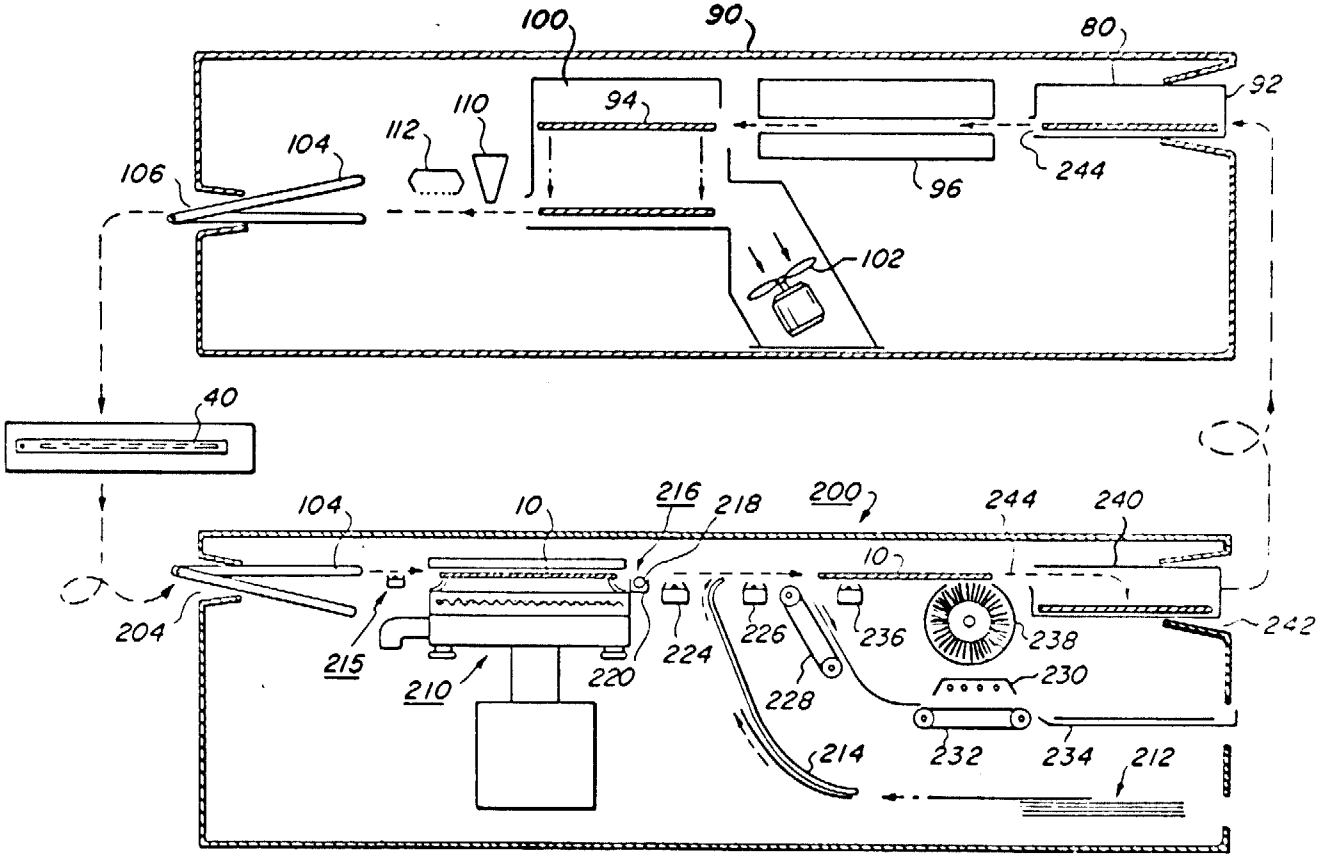
FIG. 4 is a schematic view of an automated xerographic processing system which may be utilized to implement the teachings of the present invention.

Referring to FIG. 4, there is shown a schematic illustration of the operative elements of the automated, flat-plate xerographic processing system described in U.S. Pat. No. 3,650,620 showing the relationship of two automated processing units to each other and to an external exposure station. The aforementioned processing system may be adapted to incorporate the novel techniques of the present invention with a simple modification thereto as will be described hereinafter. In order to place the present invention in proper perspective relative to the aforementioned automated processing system, the operation thereof will be briefly described.

Storage box 80 is inserted into charging unit 90 though port 92. A xerographic plate 94, with the photoconductor layer on the top side, is withdrawn therefrom and passed to conditioning means 96 where it is maintained at the appropriate temperature for a predetermined period of time whereby the residual image normally associated with the exposure of xerographic plates to high energy penetrating radiation, such as X-rays, is eliminated. After the predetermined conditioning period, the xerographic plate is withdrawn from the conditioning means 96 and passed to storage magazine 100 where it is cooled to the proper xerographic processing temperature by means of air drawn about the xerographic plate by cooling fan 102. In accordance with operating conditions described in the aforementioned patent, upon insertion of an empty cassette 104 through port 106 in charging unit 90, xerographic plate 94 is withdrawn from storage magazine 100, passed beneath vacuum cleaning means 110 and uniform electrostatic charging means 112 and into cassette 104, which is automatically released and closed whereby the uniformly charged xerographic plate is held in a light-tight environment.

Upon withdrawal of the plate-bearing cassette from the charging unit, it is taken to the external X-ray exposure station, properly positioned with respect to the radiation source and the object being examined, and exposed to imaging radiation of a reduced dosage in accordance with the teachings of the present invention.

Thereafter, the cassette, with the latent electrostatic image-bearing xerographic plate therein, is inverted and inserted into printing unit 200 through port 204. If the operating conditions are met, the cassette is automatically opened and the xerographic plate, held in proper alignment with the xerographic plate processing path by the internal structure of the cassette, is withdrawn and transported to powder cloud development means 210. During development, a single support sheet is withdrawn from support sheet supply means 212. This sheet is transported by transport means 214 to a point adjacent the path of xerographic plate travel during its advancement from the development chamber, where the sheet is stopped. After initial development, the development chamber is lowered in a manner described in the aforementioned patent and corona generator 215 is caused to scan the surface of plate 10. Thereafter, and while the development chamber is still lowered scanning means 216, comprising lamp 218 and housing 220 having an aperture slit therein, is caused to pass across and adjacent to the surface of the plate 10. It should be noted at this point that the appropriate bias level for negative images is controlled by biasing a grid interposed between the plate surface and a baffle in lieu of applying a bias directly to the plate substrate. The biasing of the grid is described in more detail in U.S. Pat. No. 3,640,246. The development chamber described in the aforementioned copending application, however, is controlled, at least as far as negative development is concerned, by appropriate biasing of the plate substrate. This latter named development chamber is, as described in the application, easily adapted for use in the automated flat-plate xerographic processing system described in U.S. Pat. No. 3,650,620. After the corona generator 215 and scanning means 216 are returned to their initial positions, the development chamber is raised to engage the plate 10 in an air sealed environment and final development is then initiated. Although the details of the drive mechanism for corona generator 215 and scanning means 216 and the modification to the timing sequence disclosed in U.S. Pat. No. 3,650,620 as a result thereof have not been shown, it is believed that these machine modifications are within the capabilities of one skilled in the electromechanical arts. After the final development step, the xerographic plate, with the powder image thereon, is transported out of the development means, over pretransfer corotron 224 which uniformly charges the photoconductive surface and the powder image to a first polarity. As the leading edge of the xerographic plate comes into registration with the stationary support sheet, they are caused to move in synchronization over transfer corotron 226 which charges the back side of the support sheet to a polarity opposite the charging polarity utilized by pre-transfer corotron 224, whereby the powder image is transferred to the support sheet. Continued movement of the xerographic plate in synchronization with the underlying support sheet causes the support sheet with the toner image thereon to come in contact with gripper bar transport assembly 228 which strips the support sheet from its position adjacent the xerographic plate and transports the support sheet to fuser means 230 where the powder image is permanently bonded to the support sheet surface. Continued rotation of belt transport means 232 within the fuser means causes the ejection of the xerographic copy into receiving tray 234.

After the support sheet has been stripped from its position adjacent the xerographic plate, the plate passes over pre-clean corotron 236 and into contact with brush cleaner 238 which removes residual toner from the photoconductive surface. The movement of the plate is continued into inverted storage box 240. To complete the cycle, it is only necessary to withdraw storage box 240 from printing unit 200 through port 242, invert the storage box such that slot 244 is in the lower left-hand corner, and insert the storage box into charging unit 90 through port 92. In this manner, the xerographic plates can be resued for subsequent xerographic processing.

In order to reduce granularity of the negative image, the surface of the photoreceptor may be slightly AC charged after initial development.

Figure 5A:
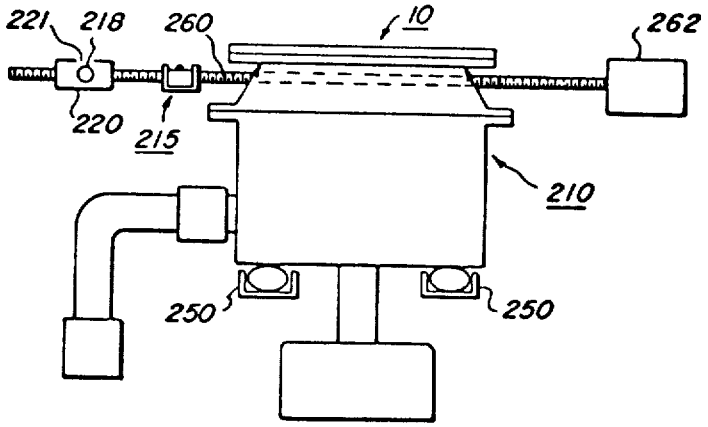
FIGS. 5A and 5B illustrate in schematic form the implementation of the charging and light scanning step in the system described with reference to FIG. 5.

FIGS. 5A ad 5B illustrate in schematical form the corona charging and light scanning steps of the present invention utilizing the automated flat-plate processing system described with reference to FIG. 4.

After the plate 10 is positioned above development chamber 210, the development chamber is raised into contact with plate 10 by inflatable means 250 (FIG. 5A) and the image is partially developed by applying approximately five bursts of toner to the chamber. After initial (partial) development, chamber 210 is lowered (FIG. 5B) and lead screw 260 and corona generator 215 are energized for depositing a positive charge on the surface of plate 10, the former by motor 262. Corona generator 215 initially traverses the plate surface in the direction of arrow 264. After the initial traverse, corona generator 215 returns in the direction of arrow 266 to its initial, or home, position. After corona generator 215 reaches its initial position, lead screw 260 and lamp 218, mounted thereon, are energized for scanning, the former by motor 262. Scanning means 216 initially scans the plate surface in the direction of arrow 264, the light generated from lamp 218 being emitted from aperture slit 221. After the initial scan, the scanning means returns in the direction of arrow 266 to its initial, or home position. Although corona generator 215 and scanning means 216 are shown driven by the same lead screw, each may be driven separately. After scanning means 216 reaches its initial position, the development chamber is raised (position shown in FIG. 5A) and finally development occurs by applying approximately ten bursts of toner. After final development, the chamber is lowered and the normal process continues.

Figure 5B:
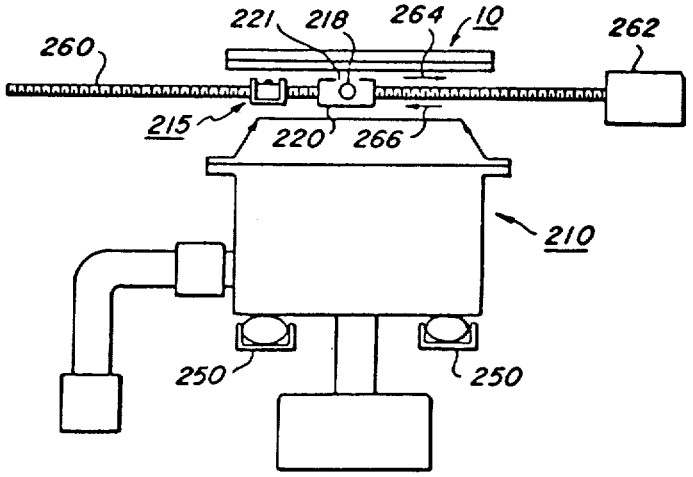

The development chamber shown in FIGS. 5A and 5B is described in detail in U.S. Pat. No. 3,640,246. It is to be recalled that the development chamber described in the aforementioned copending application may be utilized with appropriate modification since the plate is raised or lowered onto the development chamber.

It should be noted that two development chambers, one for initial or partial development, and the other for final development, can be utilized in lieu of the single development chamber as described hereinbelow.

If it is desired to utilize a different colored toner for the initial and final development steps to increase image contrast, a second toner dispenser may be added. Alternatively, a single tone dispenser with two separate compartments, each having a separate aspirator tube, can be utilized.

The system described hereinabove may be arranged wherein the corona generator and scanning means are maintained outside the development chamber is a fixed position and the plate transported thereacross in sequence, after initial development, the plate thereafter being returned to the chamber for final development.

While the invention has been described with reference to its preferred embodiments, it will be understood by those skilled in the art that various changes may be made and equivalents may be substituted for elements thereof within departing from the true spirit and scope of the invention. In addition, many modifications may be made to adapt a particular situation or material to the teaching of the invention without departing from its essential teachings.

What is claimed is:

1. Apparatus for increasing the potential difference between two adjacent charge patterns of differing charge density formed on a photoconductive surface comprising:

a. a photoconductive surface having at least two adjacent charge patterns of differing charge density thereon, said charge patterns being of a first polarity, b. means for depositing a developer powder which is charged to said first polarity on said photoconductive surface whereby said developer powder is deposited denser in the areas of lower surface charge density, thereby providing a developed charge pattern, c. means for applying charge of said first polarity to said developed charge pattern, said means for applying charge of said first polarity comprising additional means for applying charge other than said associated with providing said adjacent charge patterns of differing charge density, d. means for exposing the charged developed charge pattern to light, and e. means for applying additional developer powder charged to a second polarity to said developed charge pattern whereby the potential difference between adjacent charge patterns of differing density is at least equal to the initial potential difference therebetween.

2. The apparatus as defined in claim 1 wherein the initially deposited developer powder forms a mask which absorbs light in proportion to the density of the deposited developer powder.

3. The apparatus as defined in claim 2 further including means for a.c. charging said photoconductive surface subsequent to depositing developer powder charged to said first polarity.

4. Apparatus for increasing the potential difference between two adjacent latent electrostatic charge patterns of differing charge density formed on a photoconductive surface, said latent electrostatic charge patterns being produced by positioning an object to be imaged adjacent said photoconductive surface and exposing said object to penetrating radiation comprising:

a. a charged photoconductive surface adjacent an object to be imaged, b. means for generating penetrating radiation, said penetrating radiation passing through said object and onto said charged photoconductive surface whereby an electrostatic image of said object is formed on said surface, at least two adjacent charge patterns of differing charge density being formed on said photoconductive surface, said charge patterns being of a first polarity, c. means for depositing a developer powder which is charged to said first polarity on said photoconductive surface whereby said developer powder is deposited denser in the areas of lower surface charge density, thereby providing a developed image, d. means for applying charge of said first polarity to said developed image, said means for applying charge of said first polarity comprising additional means for applying charge other than means associated with providing said adjacent charge patterns of differing charge density, e. means for exposing the charged developed image to light, and f. means for applying additional developer powder charged to a second polarity to said developed image whereby the potential difference between adjacent charge patterns of differing density is at least equal to the initial potential difference therebetween.

5. The apparatus as defined in claim 4 wherein the initially deposited developer powder forms a mask which absorbs light in proportion to the density of the deposited developer powder.

6. The apparatus defined in claim 4 further including means for a.c. charging said photoconductive surface subsequent to depositing developer powder charged to said first polarity.

* * * * *